United States Patent [19]

Puckett

[11] Patent Number: 4,886,008

[45] Date of Patent: Dec. 12, 1989

[54] FRAME SPAR FOR SOFT AIRFOILS

[76] Inventor: Lawrence J. Puckett, 3106 Whitefield Rd., Churchville, Md. 21028

[21] Appl. No.: 154,838

[22] Filed: Feb. 11, 1988

[51] Int. Cl.[4] ..... B63H 9/06

[52] U.S. Cl. ..... 114/102; 114/39.1; 114/89; 114/90; 114/98

[58] Field of Search ..... 114/39.2, 89, 90, 97, 114/98, 102, 104, 105, 106, 107

[56] References Cited

U.S. PATENT DOCUMENTS

| | | | |
|---|---|---|---|
| 1,813,937 | 7/1931 | Krussand | 114/39.1 |
| 2,147,501 | 2/1939 | Ryder | 114/102 |
| 2,804,038 | 8/1957 | Barkla | 114/39.1 |
| 3,142,282 | 7/1964 | Nichols | 114/89 |
| 3,464,379 | 9/1969 | Lawson | 114/102 |
| 4,603,648 | 8/1986 | Berge | 114/90 |
| 4,633,797 | 1/1987 | Hoyt | 114/97 |
| 4,723,498 | 2/1988 | Stampe | 114/98 |

FOREIGN PATENT DOCUMENTS

| | | | |
|---|---|---|---|
| 967484 | 11/1950 | France | 114/103 |
| 8600661 | 10/1987 | Netherlands | 114/90 |

*Primary Examiner*—Sherman D. Basinger
*Assistant Examiner*—Thomas J. Brahan
*Attorney, Agent, or Firm*—Saul Elbaum; Freda L. Krosnick

[57] ABSTRACT

A sloop comprising a mast in the form of an A-frame with its plane athwartships. The luff of the mainsail is supported by a mainstay which is a thin wire or rod running from the apex of the A-frame vertically to a point on deck between the legs of the A-frame. This structure eliminates the turbulence along the leading edge or luff of the mainsail caused by conventional masts, and also permits a headsail to be closely hauled. The A-frame comprises one or more rigid horizontal spreaders and the mainsail boom and a spinnaker pole can be slidably mounted thereon.

4 Claims, 3 Drawing Sheets

FRAME SPAR FOR SOFT AIRFOILS

RIGHTS OF THE GOVERNMENT

The invention described herein maybe manufactured, used and licensed by or for the Government for governmental purposes without the payment to me of any royalties thereon.

BACKGROUND OF THE INVENTION

The field of this invention is sailboats and more particularly sloop-rigged sailboats in which the sails are supported in a novel manner to yield enhanced performance in all regimes of sailing. While the invention has particular utility in connection with sailboats, it is relevant and applicable to other air, land and water craft which exploit the interaction of wind with soft airfoils to produce lift or driving forces, either in static or dynamic conditions. Examples of such other craft would be airfoil-equipped air-dropped materiel including certain classes of smart munitions, compact or foldable lightweight aircraft such as remotely piloted aircraft, parachutes, and windmills.

Most modern high performance sailboats are sloops, the best known examples being the 12 meter yachts used in all recent America's Cup races. Conventional sloop design comprises a single mast located forward of amidships with a support-system comprising guy wires known as stays and shrouds connected between the mast and the deck. One or more horizontal compression members known as spreaders may be attached crosswise to the mast and connected to the shrouds to provide a triangular, truss configuration for better support of the mast.

A sloop's sails, in all sailing regimes except sailing downwind, act as airfoils which generate lift just as do the wings of an aircraft. The wind which flows along the convex or leeward side of the sail must travel farther than the wind which flows on the opposite side thereof and hence the air pressure is reduced on the convex side. This air pressure differential creates lift which tends to pull the sail and the boat generaly at right angles to the plane of the sail. This lift force can be resolved into a forward component and a sideways component. The undesired sideways component is opposed by the hydrodynamic lift forces of the keel, the hull and the rudder. Thus sloops and other sailboats when sailing close to the wind can have a substantial upwind component of velocity. Optimum lift requires an optimum angle of incidence (or angle of attack) of the apparent wind with the luff of the sail. Also, the sail camber, or fatness, must be varied with apparent wind velocity in order to control the power produced by the sail. For example, in high wind conditions, when sailing close to the wind, a sail with a small camber is required to prevent over powering. Thus, sail flattening can be used to depower sails and reduce the heel angle of the boat. Also, the change in apparent wind direction and velocity with elevation above the water requires that the mid and upper portions of sails be twisted forward relative to the lower portions to optimize lift and thus propulsive forces.

The conventional sloop rigging described above has the serious disadvantage that the mast induces air turbulence along the leading edge, or luff, of the mainsail attached thereto. Such turbulence destroys the laminar flow of air over a substantial portion of the convex or leeward side of the sail and thus greatly reduces the air velocity which is essential for the production of lift. The present invention comprises a rigging system for sloops which removes the mast from the luff area of the mainsail to eliminate the turbulence and improve the lift characteristics of the sail.

Prior art efforts to reduce mast-induced turbulence have involved utilizing very thin masts which required extensive bracing and support in the form of highly tensioned stays and shrouds with long spreaders. The high tension in the stays and shrouds can cause hull distortion and in rough seas the highly tensioned wires can cause mast bending or bowing and even mast failure, with disastrous consequences. Also, the long spreaders restrict the close hauling of the headsail or jib which is necessary to achieve optimum performance when sailing close to the wind. Thus, some sloops have been designed with thin masts as well as short spreaders, which must be compensated for with greatly increased stay and shroud tension with its attendant disadvantages noted above.

The present invention alleviates, to a great extent, these opposing design requirements and provides virtually turbulence-free entry for the mainsail, while providing a strong mast with only moderately tensioned structural elements, which utilize a narrow support base. These features, in addition to providing high lift, will reduce hull construction cost and weight.

The prior art includes numerous sail rigs which remove the mast from the luff area of the mainsail. One of these is shown in U.S. Pat. No. 4,044,702, issued on Aug. 30, 1977. That patent shows in one embodiment a tripod mast with the head of the sail attached to the tripod apex and the foot thereof attached to a boom which rotates atop a short, deck-mounted mast which is directly below the tripod apex. The luff and leech edges of the sail are supported by cables extending from the ends of boom to the tripod apex. Another embodiment utilizes a more or less conventional mast with a boom offset therefrom by means of a short spar which pivots around the mast. The tripod embodiment of that patent is not applicable to the present invention since it has no headsail and thus loses the efficiency of a sloop when sailing "on the wind" and similarly it loses the efficiency of the "unblanketed spinnaker" when sailing "off the wind." The second embodiment described above which might be adaptable to sloops with conventional hulls, would not be adaptable to bowing or bending of the mast which is often desirable to flatten the sail to reduce power and heeling moment.

U.S. Pat. No. 4,273,060, issued in June 16, 1981 shows an A-frame mast mounted on an omnidirectional hull, with a sail fixed in position within the A-frame, the boat heading being varied to change the angle of the sail to the wind. This design does not permit a headsail or jib to be used, which is essential if maximum lift and efficiency is to be obtained. This patent thus does not relate to a sloop.

SUMMARY OF THE INVENTION

The novel sloop of the present invention replaces the conventional mast with a small diameter wire, cable or rod called the mainstay which is supported at its upper end at the apex of an A-frame which has its feet anchored to, or through, the deck below the A-frame apex and is tensioned and secured to the spreaders to prevent sagging and bowing caused by aerodynamic forces acting on the mainsail which is attached thereto. The mainsail halyard is supported in conventional fashion at the A-frame apex. The A-frame is provided with one or more rigid spreaders which horizontally connect the legs thereof, and/or anti-spreaders comprising wire cables similarly located to prevent buckling of the A-frame legs. The design facilitates the mounting of a headsail or a spinnaker. The spinnaker pole can be mounted on either leg of the A-frame of anywhere in between if a slidable mounting is provided on one of the spreaders. A conventional boom is supported at its forward end by the lowermost of the spreaders. The end of this boom can slide in a track on the aft side of the spreader (similar to that used for the spinnaker pole), for athwartship positioning of the boom. A conventional backstay and headstay are used to support and apply compression to the A-frame. The headstay can be used to support a headsail. A second short headstay (or babystay) may be used to bow or bend the midsection of the A-frame foward for depowering the sail.

Briefly stated, the invention comprises an A-frame mast mounted athwartships and supported by a backstay and one or more headstays, with a mainstay running from the apex of the A-frame vertically down to a point on deck below said apex, one or more horizontal spreaders connecting the legs of said A-frame, with a boom pivoting around an attachment to the lower most of said spreaders.

An object of the invention is to provide a sloop with a mainsail which is supported along its luff by a thin flexible cable or rod which provides turbulence-free aerodynamic entry for the leading edge of said sail, the head of said cable being supported at the apex of an A-frame which is mounted athwartships and which supports the mainsail halyard and its block, whereby the novel mast accommodates sails which are conventional sloop sails and which are hoisted, reefed and rimmed in the same manner as would the sails of conventional sloops.

A further object of the invention is to provide a sloop with an A-frame which provides support for conventional sloop sails while eliminating mast-induced turbulence along the mainsail luff and in which the A-frame design permits low stress in the structural members thereof and in its supporting structural members, resulting in low cost construction and greater safety compared to conventional mast designs, and wherein the headsail of said sloop may have its clew extending aft of said A-frame and well inboard of the hull's gunwale to provide for close-hauled trimming of said headsail.

DETAILED DESCRIPTION OF A PREFERRED EMBODIMENT

Figure 1A:
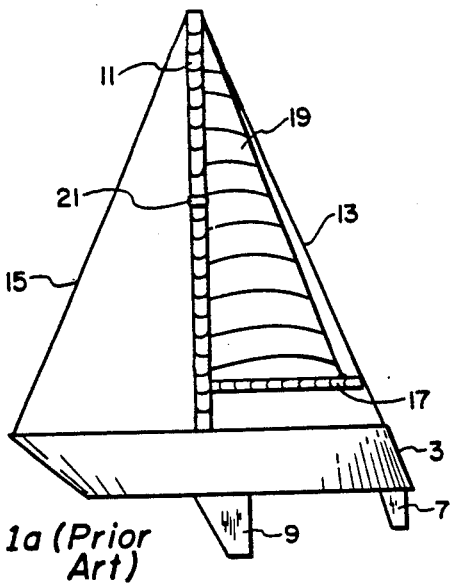
FIG. 1a (Prior Art)
FIGS. 1*a* and 1*b* show a conventional sloop rigging.
Figure 1B:
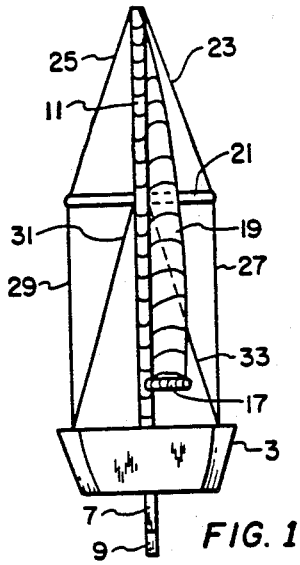
FIG. 1b (Prior Art)

The conventional sloop design is shown in the side view of FIG. 1*a* and the stern view of FIG. 1*b*. This sailboat comprises a hull 3, keel 9, rudder 7, mast 11, mainsail 19 and boom 17. The mast is braced by headstay 15 which extends from the masthead to the bow and the backstay 13 which extends from the masthead to the transom area. The stern view of FIG. 1*b* shows how the shrouds 23, 25, 27, 29, 31 and 33 and the spreader 21 provide additional mast bracing. The spreader is a rigid compression member attached to the mast and it increased the effectiveness of the shrouds by providing a triangular truss-like support system for the mast. All of the shrouds and stays normally comprise wire cables in tensions which place the mast and spreader in compression. No jib or other headsail is shown in FIGS. 1*a* or 1*b*, however, it can be seen that the spreader 21 is almost as long as the boat's beam and this might prevent a jib from being closely hauled. Shortening of the spreader can permit this close hauling but requires higher shroud tension with its disadvantages noted above. On the other hand, the present invention requires only moderately stressed elements for its A-frame and its supporting wire system, and thus the likelihood of hazards such as catastrophic mast failure are reduced.

Figure 2A:
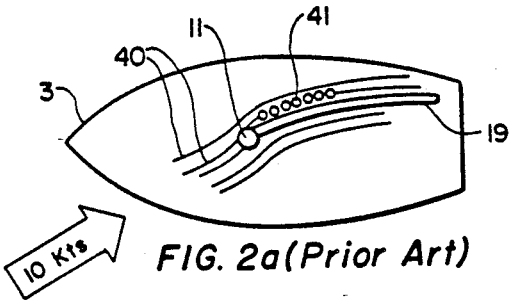
FIG. 2a(Prior Art)
FIGS. 2*a*, 2*b* and 2*c* illustrate the airflow around the mainsail of a conventional sloop.

FIG. 2*a* shows a top view of the conventional sloop of FIGS. 1*a* and 1*b* with the boat sailing close to a 10 knot relative wind indicated by the arrow so-labeled. Before the wind strikes the mast 11, it will normally be characterized by laminar flow indicated by the parallel flow lines at 40. Laminar flow obtains whenever the relative velocity difference between adjacent layers of air is below a critical figure. As the air passes around the mast 11, the layer of air close to the mast will be slowed down more than the layers further away. This will result in the generation of turbulence in the form of eddy currents shown at 41 which destroy the laminar air flow over the convex surface of the mainsail 19. The lift of the soft airfoil comprising the mainsail will be greatly reduced. The kinetic energy of the wind is now partly consumed by the swirling eddies which leaves less energy for boat propulsion.

Figure 2B:
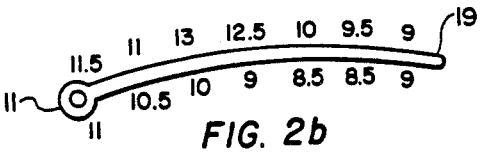

FIG. 2*b* shows how wind velocities may vary on both sides of the sail 19 when the craft is sailing into the wind shown in FIG. 2*a*. The numbers indicate localized relative wind velocities in knots. Notice that the wind on the convex or leeward side of the sail varies erratically, first increasing to 11.5 then decreasing to 11, increasing again to 13, then decreasing to 10 knots, etc. This is a result of the eddy currents 41, induced by mast 11.

Figure 2C:
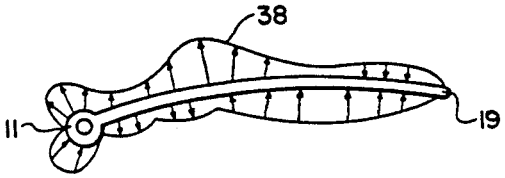

FIG. 2*c* illustrates with arrows the direction and magnitude of the lift forces produced by the velocities of FIG. 2*b*. As shown in FIG. 2*c*, the erratic velocities result in an uneven and generally low-lift pressure pattern 38 over the soft airfoil comprising the sail 19.

Figure 3A:
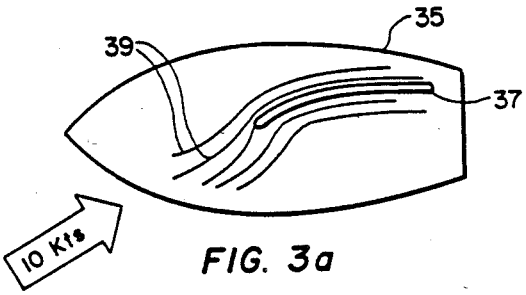
FIGS. 3*a*, 3*b*, and 3*c* illustrate the laminar non-turbulent airflow past the mainsail of the sloop of the present invention.
Figure 3B:
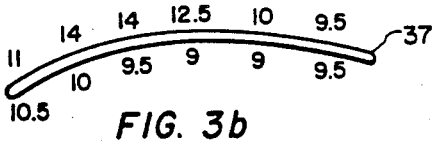
Figure 3C:
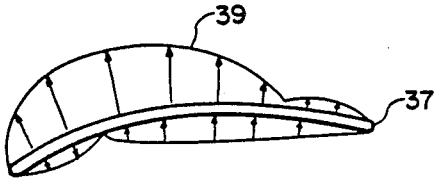

FIG. 3*a* shows how the removal of the turbulence-inducing mast from the leading edge or luff area of a sloop's mainsail 37 results in a smooth, high speed laminar flow of the relative wind over the sail. As shown, a greater portion of the air-flow lines 39 are laminar resulting in the production of high lift and hence maximum propulsive force. The wind velocity diagram of FIG. 3*b* shows that the air velocity on the convex side of the sail continually increases to a maximum of 14 knots and then gradually and continuously decreases. This results in a large pressure pattern 39 as is shown in FIG. 3*c*.

Figure 4A:
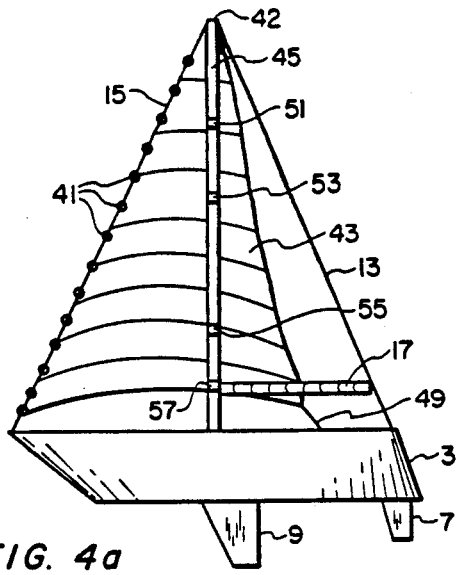
FIGS. 4*a* and 4*b* are two views of a sailboat constructed according to the present invention.
Figure 4B:
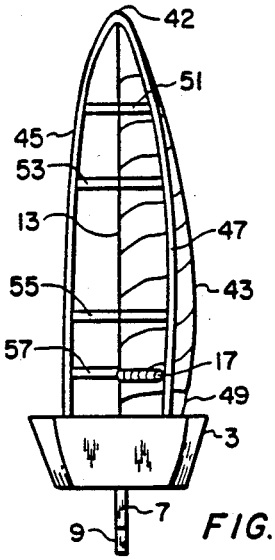

FIGS. 4*a* and 4*b* are side and stern views of a sloop equipped with a mast comprising an A-frame in accordance with the present invention. The mast is located where a conventional mast would be, that is somewhat forward of amidships. The A-frame comprises a starboard leg 47 and a port leg 45, both curved and meeting at an apex 42. The A-frame is supported by a headstay 15 and a backstay 13 in conventional fashion. The plane of the A-frame is athwartships and thus at right angles to the plane of the keel. The span of the A-frame at its base is typically less than that of the spreaders and shrouds of a conventional sloop rig. The narrower base span permits a headsail to be closely hauled. Such a closely-hauled headsail or jib 43 is shown in FIGS. 4*a* and 4*b*. The luff of the jib 43 is attached to the heedstay 15 with jib hanks 41 in conventional fashion and it can be closely hauled with its clew aft of the A-frame by taking up on jib sheet 49. The luff of the jib may be supported in a grooved headstay for more aerodynamic efficiency.

The A-frame is provided with spreaders 51, 53, 55 and 57 to provide it with strength and rigidity, although the number and location of such spreaders is adjustable. The spreaders normally would be of high strength metal or composite material and thus would resist the tendency on the part of the A-frame legs to buckle either inwardly or outwardly. If only outward buckling is anticipated, one or more of the rigid spreaders could be replaced by a wire cable or cables. A wire or rod called a mainstay (not shown in FIGS. 4*a* or 4*b*) runs vertically from the A-frame apex to a point on deck approximately halfway between the feet of the frame. The mainstay provides support for the luff of the mainsail and also applies compression to the A-frame. The lowermost of the spreaders 57 has the forward end of the boom 17 pivotally attached thereto in conventional fashion, or it can be pivotally attached to a sliding member which slides in a track on the spreader, to permit athwartships adjustments of the boom. The mainsail halyard block is supported at the A-frame apex and the jib block may also be supported there. Thus the mainsail (now shown in FIG. 4*a* or 4*b*) and the headsail are raised, lowered, trimmed and reefed just as they would be on a conventional sloop.

Figure 5:
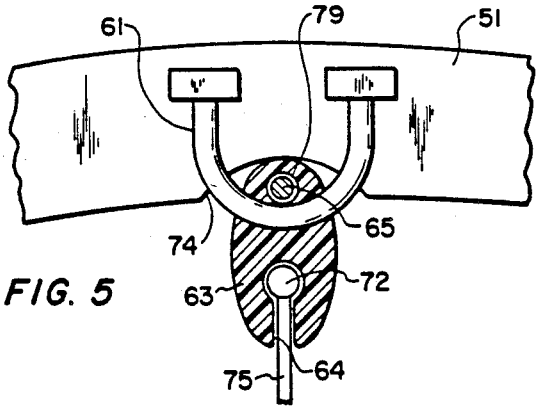
FIGS. 5 and 6 illustrate how the luff of the mainsail is attached to the mainstay.
Figure 6:
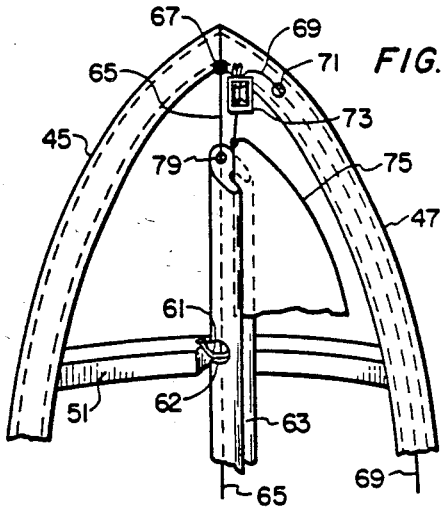

FIGS. 5 and 6 show how the mainsail 75 can be attached to the mainstay 65. In FIG. 6 the mainstay is shown anchored at 67 to the apex of the A-frame. The A-frame legs, 45 and 47, are preferably hollow as indicated by the dashed lines inside thereof. This construction yields maximum strength to weight ratio and also results in a lower center of gravity which reduces the probability of capsizing. Also, the halyards can be run inside the hollow legs. The mainsail halyard 69 is shown running inside leg 47 and through hole 71 therein, over halyard block 73 which is suspended near the A-frame apex, to the head of mainsail 75. The mainsail luff is made fast to the mainstay 65 by means of mainfoil 63, which is similar in structure and function to headfoils which have been used in the prior art to secure the luff of jibs to headstays. FIG. 5 is a top view of the spreader 51 of the sailboat of FIGS. 4*a* and 4*b*, showing a cross-section of the mainfoil 63 with the mainstay 65 running through a hole 79 therein. The mainfoil extends from just below the A-frame apex to the boom. The mainstay is threaded through hole 79 before it is attached to the deck area and thus the mainfoil remains fixed in position on the mainstay, as shown in the pictorial view of FIG. 6. For some foil designs, the mainfoil may be assembled on the mainstay. As shown in FIG. 6, the mainstay and the mainfoil are anchored to the spreader 51 by means of a shackle 61 which passes through a notch or recess 62 in the forward edge of the mainfoil. The recess 62 is large enough to encompass the hole 79 and the mainstay which passes through it. The mainstay and mainfoil are thus securely anchored to each spreader to prevent the mainsail luff from shifting due to wind loading and to permit A-frame bending, to be described, to be transmitted to the mainfoil for the purpose of changing the shape of the mainsail.

The aft edge of the mainfoil has a groove 64 therein in which the luff of the mainsail is inserted. A flexible line or rope 72 is sewn into the luff edge of the mainsail and this is inserted into the enlarged bottom (or forward) end of groove 64 so that the mainsail luff is securely attached to the mainfoil along its entire length. The forward edge of the mainfoil may be held by the shackles in grooves, such as 74, which are centrally located on the aft sides of each of the spreaders. The luff of the mainsail slides up and down in groove 64 when the mainsail is raised and lowered.

The mainfoils are preferably given an aerodynamic shape so that they present minimum drag and cause minimum turbulence when the sloop is beating to windward. The small frontal area of the mainfoil is much less than that of even the thinnest of conventional masts so that the aerodynamic design thereof is usually not necessary except in racing sloops where the last fractional knot of extra speed may be critical.

Figure 7:
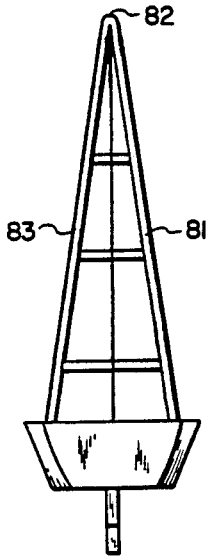
FIGS. 7 and 8 illustrate alternate shapes for the A-frame.
Figure 8:
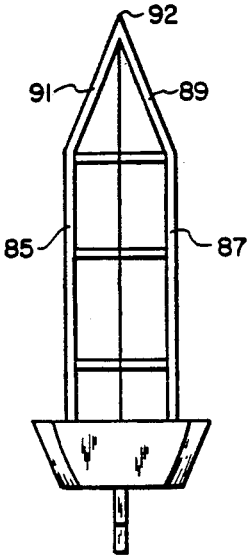

FIG. 7 shows an alternate shape for a A-frame which comprises a pair of straight legs 81 and 83 angled toward each other, as shown, and meeting at the apex 82. The alternate-shaped A-frame of FIG. 8 comprises a pair of straight, parallel legs 85 and 87 with straight but angled legs 89 and 91 attached thereto and meeting at apex 92. These drawings are indicative of variations of the A-frame concept. and are not intended to be restrictive or all-inclusive.

Figure 9:
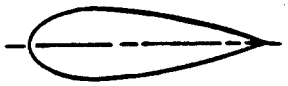
FIGS. 9, 10 and 11 are examples of optional cross-sections of the A-frame legs.
Figure 10:
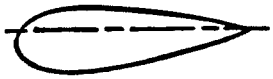
Figure 11:
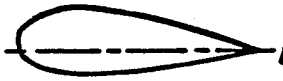

FIG. 9 shows a preferred design for the cross-sectional shape of both the A-frame legs and spreaders. This teardrop design, with the left side facing the sloop's bow, will minimize aerodynamic drag of these structures. FIGS. 10 and 11 show other cross-sectional designs which may be used for the starboard and port legs of the A-frame, respectively. Each of these designs illustrate an inboard surface with greater camber than that of the outboard surface, so that when the sloop is beating to windward, the A-frame leg on the leeward side acts as an air foil to generate a small amount of lift. Additionally, the flat outboard sides of the legs permits the headsail to be sheeted to the point where it is in contract with the leg, and the flattened outboard surface of the leg will produce minimum disturbance to the airflow on the windward side of the headsail.

Figure 12:
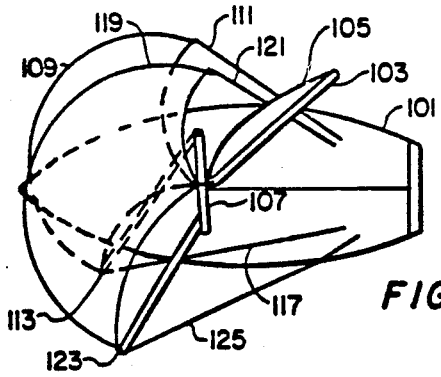
FIGS. 12 shows how a spinnaker may be attached to the A-frame.

FIG. 12 illustrates how the present A-frame design facilitates different riggings of a spinnaker. In this top view are shown two different spinnaker riggings, one with the inboard end of spinnaker pole 113 attached to the starboard side of the A-frame 107, and the other with the inboard end of spinnaker pole 123 attached to the port side of the A-frame. The spinnaker pole 113 has attached thereto the tack of spinnaker 109, the clew of which is attached to spinnaker sheet 111. The spinnaker guy 117 is attached to the outboard end of pole 13. The other spinnaker pole 123 is attached to the tack of spinnaker 119, the clew of which is attached to its sheet 121. The guy 125 is attached to the pole 123.

The inboard end of the spinnaker pole may be attached to the forward side of either the lower spreader or the one immediately above the lowest, or spinnaker pole anchor points may be provided anywhere on the forward side of the A-frame legs or spreaders. Also, a track may be located on the forward side of the one or more of the spreaders and the inboard end of the spinnaker pole made moveable therein and lockable at any position.

Different spinnaker riggings are desirable, for example, to obtain maximum lift from mainsail 105 by creating a slot forward of the luff of the mainsail so that more air at higher velocity and from a favorable direction will impinge on the leading edge of the airfoil comprising the mainsail, or, when sailing before the wind, the slidable spinnaker pole permits the spinnaker to be adjusted for more or less power.

Figure 13A:
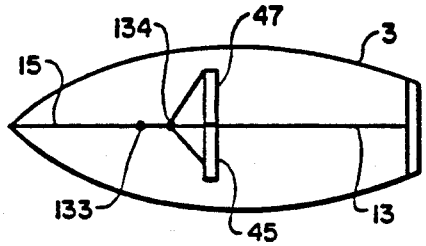
FIGS. 13*a* and 13*b* show how a short auxiliary headstay can be used to bend the A-frame.
Figure 14A:
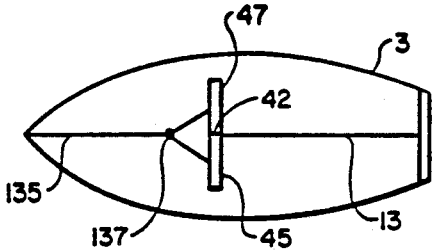
FIGS. 14*a* and 14*b* show how the novel sloop may be rigged to provide for a fractional headsail.
Figure 13B:
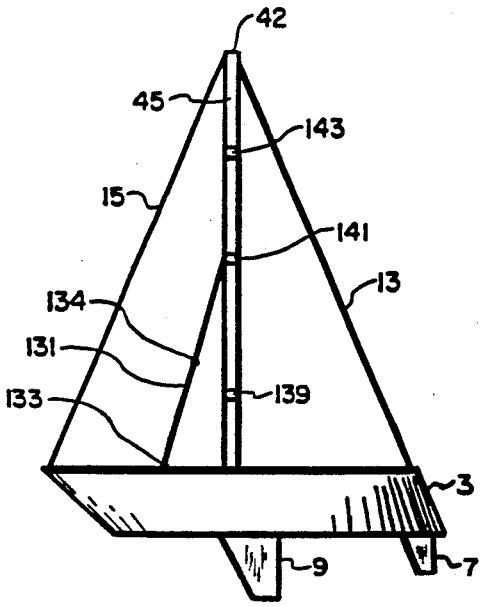
Figure 14B:
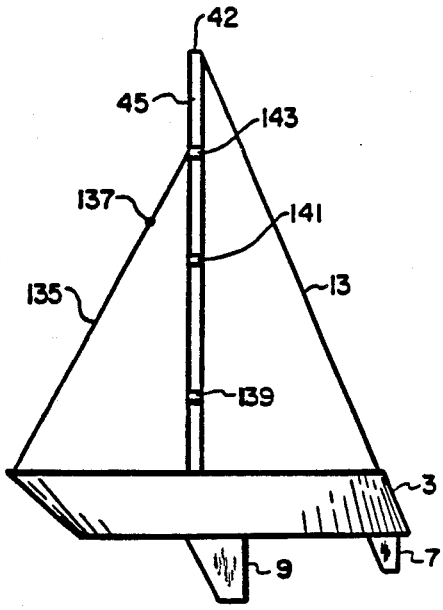

FIGS. 13*a* and 13*b* are top and side views of a sloop equipped with an A-frame according to the present invention and showing how an auxiliary headstay (or babystay) 131 may be arranged to bend or bow the A-frame to reduce the mainsail camber and thus flatten the mainsail at its midheight. This auxiliary headstay is anchored on the deck at point 133 and is anchored to both legs 45 and 47 of the A-frame just below the spreader 141. As shown in FIG. 13*a*, at point 134 it forks, with each of the two forked cables extending to and anchored onto the forward side of a different one of the A-frame legs. The application of tension to this auxiliary stay, for example, by means of a block and tackle, will cause the midsection of the entire A-frame to be bent forward, the feet and the apex of which will remain more or less fixed. This bending in turn will bend the midsection of the mainfoil and the attached luff of the mainsail. For those sloops equipped with a fractional headsail, as is indicated in FIGS. 14*a* and 14*b*, the bending of the mainfoil may be accomplished in a similar manner by tensioning the headstay 135. For either configuration shown in FIGS. 13*a* and *b* or 14*a* and *b*, this will flatten the mainsail midsection, reduce its camber and effect a depowering thereof. A slight bending of the A-frame in this manner may actually increase boat speed in high wind conditions by reducing the camber which enables the airflow to remain attached to the sail. This follows from the fact that optimum airfoil camber varies directly with wind velocity.

If mast bending is not important to the boat's performance, the mainfoil, the auxiliary headstay, and even the mainstay can be dispensed with and the head of the mainsail attached and supported only by the end of its halyard, and the tack of the mainsail attached to the lowermost of the spreaders near the attachment point of the boom thereto.

While the invention has been described in connection with illustrative embodiments, obvious variations therein will occur to those skilled in this art without the exercise of invention, accordingly the invention should be limited only by the scope of the appended claims.

What is claimed is:

1. A sailboat comprising a mast which comprises an A-frame mounted athwartships with its plane perpendicular to that of the sailboat's keel, said A-frame comprising port and starboard legs which converge to form an apex directly above the plane of said keel, the legs of said A-frame being connected with one or more rigid horizontal spreaders, one of said spreaders has a track along the forward edge thereof; said A-frame being provided with a headstay and a backstay, a mainstay running from said apex vertically downward to the deck of said sailboat, a boom pivotally attached to the aft side of the lowermost of said spreaders to permit athwartship adjustments of the boom; a mainsail having its luff attached to said mainstay, its halyard supported near the said apex, its foot attached to said boom, said sailboat is rigged with a spinnaker which has the inboard end of its spinnaker pole attached to the forward side of said A-frame, and the inboard end of said spinnaker pole is adapted to slide in said track of a spreader and to be locked therein in any desired position.

2. A sailboat comprising a mast which comprises an A-frame mounted athwartships with its plane perpendicular to that of the sailboat's keel, said A-frame comprising port and starboard legs which converge to form an apex directly above the plane of said keel, the legs of said A-frame being connected with one or more rigid horizontal spreaders, said A-frame being provided with a headstay and a backstay, a mainstay running from said apex vertically downward to the deck of said sailboat, a boom pivotally attached to the aft side of the lowermost of said spreaders to permit athwartship adjustments of the boom; a mainsail having its luff attached to said mainstay, its halyard supported near the said apex, its foot attached to said boom; wherein said luff of said mainsail is attached to said mainstay by means of a mainfoil, said mainfoil comprising a narrow, elongated and semi-rigid body which extends from just below said apex to the area of said boom, said mainstay running through a hole near the forward edge of said mainfoil, said mainfoil being secured to said spreaders by mechanical means such as shackles which pass through recesses in said forward edge to engage the said mainstay, the luff of said mainsail being inserted into a second recess on the aft edge of said mainfoil, said second recess having an enlarged or cutaway bottom which is adapted to receive the luff rope which is part of the said luff of said mainsail.

3. A sailboat comprising a mast which comprises an A-frame mounted athwartships with its plane perpendicular to that of the sailboat's keel, said A-frame comprising port and starboard legs which are straight and parallel with shorter straight legs mounted atop each of said parallel legs, said shorter legs angled toward each other and meeting to form an apex directly above the plane of said keel, the legs of said A-frame being connected with one or more rigid horizontal spreaders, said A-frame being provided with a headstay and a backstay, a mainstay running from said apex vertically downward to the deck of said sailboat, a boom pivotally attached to the aft side of the lowermost of said spreaders to prmit athwartship adjustments of the boom; a mainsail having its luff attached to said mainstay, its halyard supported near the said apex and its foot attached to said boom.

4. A sailboat comprising a mast which comprises an A-frame mounted athwartships with its plane perpendicular to that of the sailboat's keel, said A-frame comprising port and starboard legs which legs may be bent or straight and which converge to form an apex directly above the plane of said keel, the legs of said A-frame being connected with one or more rigid horizontal spreaders, said A-frame being provided with a headstay and a backstay, a mainstay running from said apex vertically downward to the deck of said sailboat, a boom pivotally attached to the aft side of the lowermost of said spreaders to permit athwartship adjustments of the boom; a mainsail having its luff attached to said mainstay, its halyard supported near the said apex and its foot attached to said boom;

said sailboat further comprising an auxiliary headstay having its foot anchored on deck between said A-frame and the bow of said boat and having its head attached to the midsection of said A-frame, said auxiliary headstay being forked near its head with each fork connected to a different one of the said legs of said A-frame, said auxiliary headstay may be arranged to bend or bow said A-frame.

* * * * *